US006837475B2

(12) United States Patent
Ogata et al.

(10) Patent No.: US 6,837,475 B2
(45) Date of Patent: Jan. 4, 2005

(54) VALVE-OPERATING DEVICE FOR ENGINE

(75) Inventors: Fumio Ogata, Wako (JP); Akihisa Shinoda, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/246,763

(22) Filed: Sep. 19, 2002

(65) Prior Publication Data

US 2003/0079700 A1 May 1, 2003

(30) Foreign Application Priority Data

Sep. 21, 2001 (JP) ..... 2001-288204
Oct. 10, 2001 (JP) ..... 2001-348080

(51) Int. Cl.[7] ..... F16K 35/00
(52) U.S. Cl. ..... 251/90; 123/90.16; 123/90.39
(58) Field of Search ..... 123/90.15–90.17, 123/90.39, 90.44, 198 F, 90.27, 90.4–90.47; 251/89–100

(56) References Cited

U.S. PATENT DOCUMENTS 4,829,948 A * 5/1989 Yoshida et al. ..... 123/90.16
5,024,191 A * 6/1991 Nagahiro et al. ..... 123/198 D
5,101,778 A * 4/1992 Fukuo et al. ..... 123/90.27
5,235,940 A * 8/1993 Nakatani ..... 123/90.16
5,669,344 A * 9/1997 Regueiro ..... 123/90.22
5,704,315 A * 1/1998 Tsuchida et al. ..... 123/90.16
5,813,376 A * 9/1998 Sakaguchi et al. ..... 123/90.16
2003/0037739 A1 * 2/2003 Wurms et al. ..... 123/90.16

FOREIGN PATENT DOCUMENTS

JP 59126011 A * 7/1984 ..... F01L/1/18
JP 8-74524 3/1996

* cited by examiner

*Primary Examiner*—Thomas Denion
*Assistant Examiner*—Jaime Corrigan
(74) *Attorney, Agent, or Firm*—Westerman, Hattori, Daniels & Adrian, LLP

(57) ABSTRACT

A valve-operating device for an engine includes a camshaft which is disposed on one side of a plane including axes of an exhaust valve and an intake valve and which has an axis substantially perpendicular to the plane. The camshaft and the exhaust and intake valves are connected to each other through a first rocker arm and a second rocker arm which are swingably carried on a rocker shaft disposed substantially perpendicular to the plane. The camshaft is formed with a large-diameter exhaust cam and a small-diameter intake cam adjoining a portion of the exhaust cam on the side of the plane. The exhaust and intake rocker arms are provided with arm portions extending in an axial direction of the camshaft to come into sliding contact with outer peripheral surfaces of the exhaust and intake cams, respectively. Thus, it is possible to open and close the exhaust and intake valves with inherent opening and closing timings, while easily avoiding interferences among components.

2 Claims, 11 Drawing Sheets

VALVE-OPERATING DEVICE FOR ENGINE

BACKGROUND OF THE INVENTION

1. Field of the Invention

The present invention relates to a valve-operating device for an engine, and particularly to an improvement in a valve-operating device for an engine, comprising: a camshaft which is disposed on one side of a plane including axes of a first valve and a second valve corresponding to one and the other of an intake valve and an exhaust valve and which has an axis substantially perpendicular to the plane; and a first rocker arm and a second rocker arm which are swingably carried on a rocker shaft disposed substantially perpendicular to the plane and through which the camshaft and the first and second valves are connected to each other, whereby the first and second valves are opened and closed by the rotation of the camshaft.

2. Description of the Related Art

A conventional valve-operating device is already known, as disclosed in Japanese Patent Application Laid-open No. 8-74524.

In the device disclosed in the above publication, the first and second rocker arms are operated by a single cam formed on the camshaft. Therefore, although the structure is simplified, the opening and closing timings provided to the first and second valves are limited.

If first and second cams are simply formed to be arranged axially on the camshaft in order to provide inherent opening and closing timings to the first and second valves, respectively, so that the first and second rocker arms can be driven individually by the cams, each of the rocker arms is inevitably provided with a complicated structure in order to avoid the interferences between the first cam and the second rocker arm and between the second cam and the first rocker arm.

SUMMARY OF THE INVENTION

Accordingly, it is an object of the present invention to provide a valve-operating device for an engine, wherein the first and second valves can be opened and closed with inherent opening and closing timings, respectively, while easily avoiding the interferences among components.

To achieve the above object, according to a first feature of the present invention, there is provided a valve-operating device for an engine, comprising: a camshaft which is disposed on one side of a plane including axes of a first valve and a second valve corresponding to one and the other of an intake valve and an exhaust valve and which has an axis substantially perpendicular to the plane; and a first rocker arm and a second rocker arm which are swingably carried on a rocker shaft disposed substantially perpendicular to the plane and through which the camshaft and the first and second valves are connected to each other, whereby the first and second valves are opened and closed by the rotation of the camshaft, wherein the camshaft is provided with a large-diameter first cam and a small-diameter second cam adjoining a portion of the first cam on the side of the plane; and wherein the first and second rocker arms are provided with arm portions extending in an axial direction of the camshaft to come into sliding contact with outer peripheral surfaces of the first and second cams.

With the first feature, only by providing the arm portions on the first and second rocker arms to come into sliding contact with the first and second cams while utilizing a step formed between the large-diameter first cam and the small-diameter second cam, the first and second rocker arms can be individually driven by the first and second cams to open and close the first and second valves with inherent opening and closing timings, while avoiding the interferences between the first cam and the second rocker arm and between the second cam and the first rocker arm. Thus, it is possible to avoid the complication of the structure of each rocker arm.

According to a second feature of the present invention, in addition to the first feature, the first and second rocker arms are supported by a single common rocker shaft.

With the second feature, using the rocker shaft common for the first and second rocker arms reduces the number of parts, leading to an improvement in assemblability and a reduction in cost.

According to a third feature of the present invention, in addition to the second feature, the first rocker arm comprises a first arm portion with opposed sidewalls of its base end having a U-shaped section being carried on the rocker shaft and with its tip end abutting against a head of the first valve, and a second arm portion protruding from one of the sidewalls of the first arm portion with its tip end being in sliding contact with an outer peripheral surface of the first cam; and the second rocker arm comprises a first arm portion with opposed sidewalls of its base end having a U-shaped section being carried on the rocker shaft inside the first arm portion of the first rocker arm and with its tip end abutting against a head of the second valve, and a second arm portion protruding from one of the sidewalls of the first arm portion with its tip end being in sliding contact with an outer peripheral surface of the second cam.

With the third feature, because the rocker shaft supports the opposite sidewalls of the base end having the U-shaped section in each of the first and second rocker arm, the support rigidity of the base end can be increased to guarantee a stable swing of each of the rocker arms. Moreover, the rocker arms can be compactly disposed by superposing their base ends on each other with one on the inner side and the other on the outer side, resulting in a compact valve-operating device.

According to a fourth feature of the present invention, there is provided a valve-operating device for an engine, comprising: a camshaft which is disposed on one side of a plane including axes of a first valve and a second valve corresponding to one and the other of an intake valve and an exhaust valve and which has an axis substantially perpendicular to the plane; and a first rocker arm and a second rocker arm which are swingably carried on a rocker shaft disposed substantially perpendicular to the plane and through which the camshaft and the first and second valves are connected to each other, whereby the first and second valves are opened and closed by the rotation of the camshaft, wherein the first rocker arm comprises a first arm portion with opposed sidewalls of its base end having a U-shaped section being carried on the rocker shaft and with its tip end abutting against a head of the first valve, and a second arm portion protruding from one of the sidewalls of the first arm portion with its tip end being in sliding contact with the camshaft; and wherein the second rocker arm comprises a first arm portion with opposed sidewalls of its base end having a U-shaped section being carried on the rocker shaft inside the first arm portion of the first rocker arm and with its tip end abutting against a head of the second valve, and a second arm portion protruding from one of the sidewalls of the first arm portion with its tip end being in sliding contact with the camshaft.

With the fourth feature, using the rocker shaft common for the first and second rocker arms reduces the number of parts, leading to an improvement in assemblability and a reduction in cost. In addition, because the rocker shaft supports the opposite sidewalls of the base end having the U-shaped section in each of the first and second rocker arms, the support rigidity of the base end can be increased to guarantee a stable swing of each of the rocker arms. Moreover, the rocker arms can be compactly disposed by superposing their base ends on each other with one on the inner side and the other on the outer side, resulting in a compact valve-operating device.

The first and second valves correspond to exhaust and intake valves 24 and 23 in an embodiment of the present invention which will be described hereinafter, respectively; the first and second cams correspond to exhaust and intake cams 66 and 65, respectively; and the first and second rocker arms correspond to exhaust and intake rocker arms 71 and 70, respectively.

The above and other objects, features and advantages of the invention will become apparent from the following description of the preferred embodiment taken in conjunction with the accompanying drawings.

DESCRIPTION OF THE PREFERRED EMBODIMENT

The present invention will now be described by way of an embodiment with reference to the accompanying drawings.

First, the entire arrangement of an engine will be described.

Figure 1:
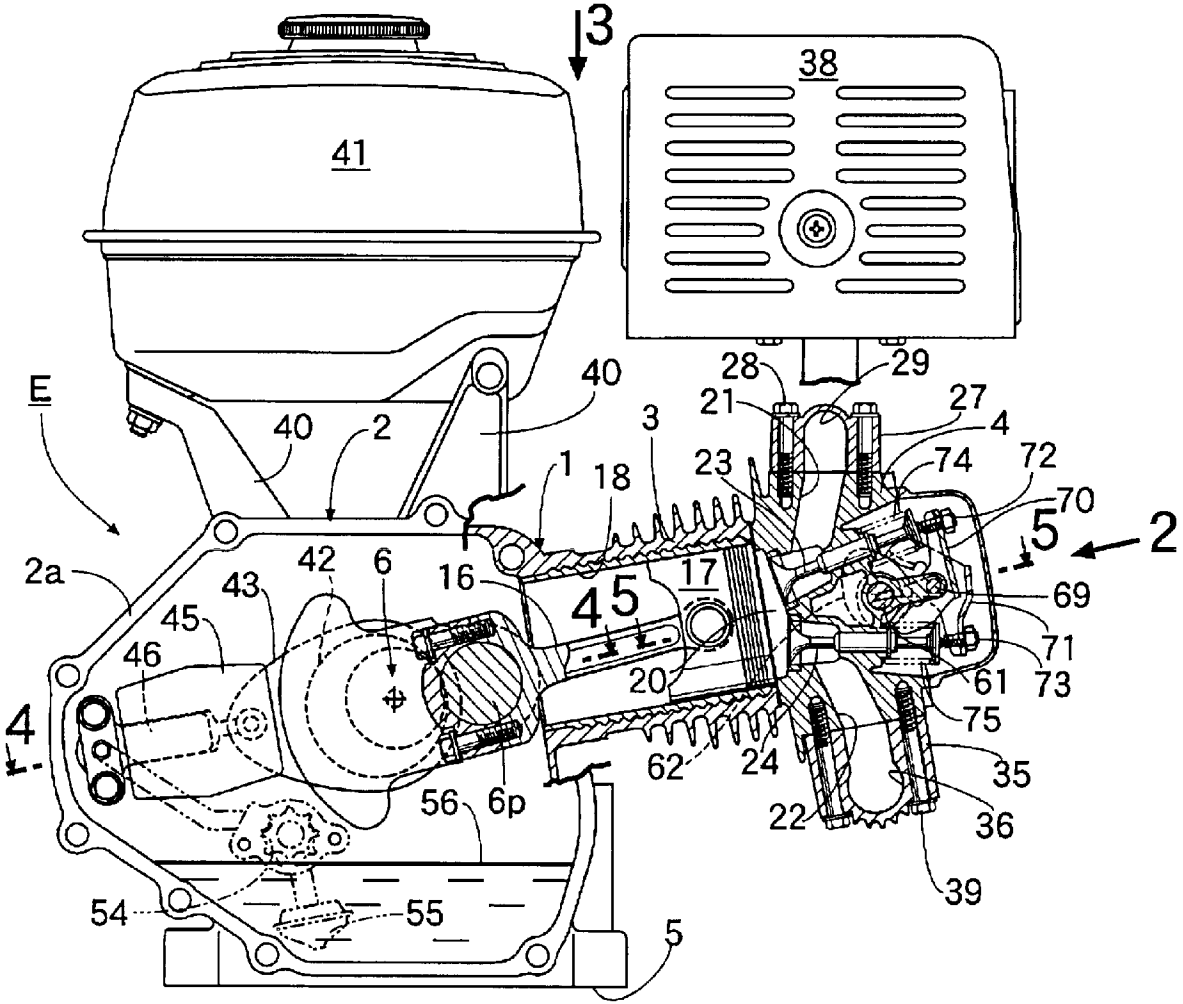
FIG. 1 is a vertical sectional side view of an essential portion of a general-purpose engine including a valve-operating device according to the present invention.
Figure 4:
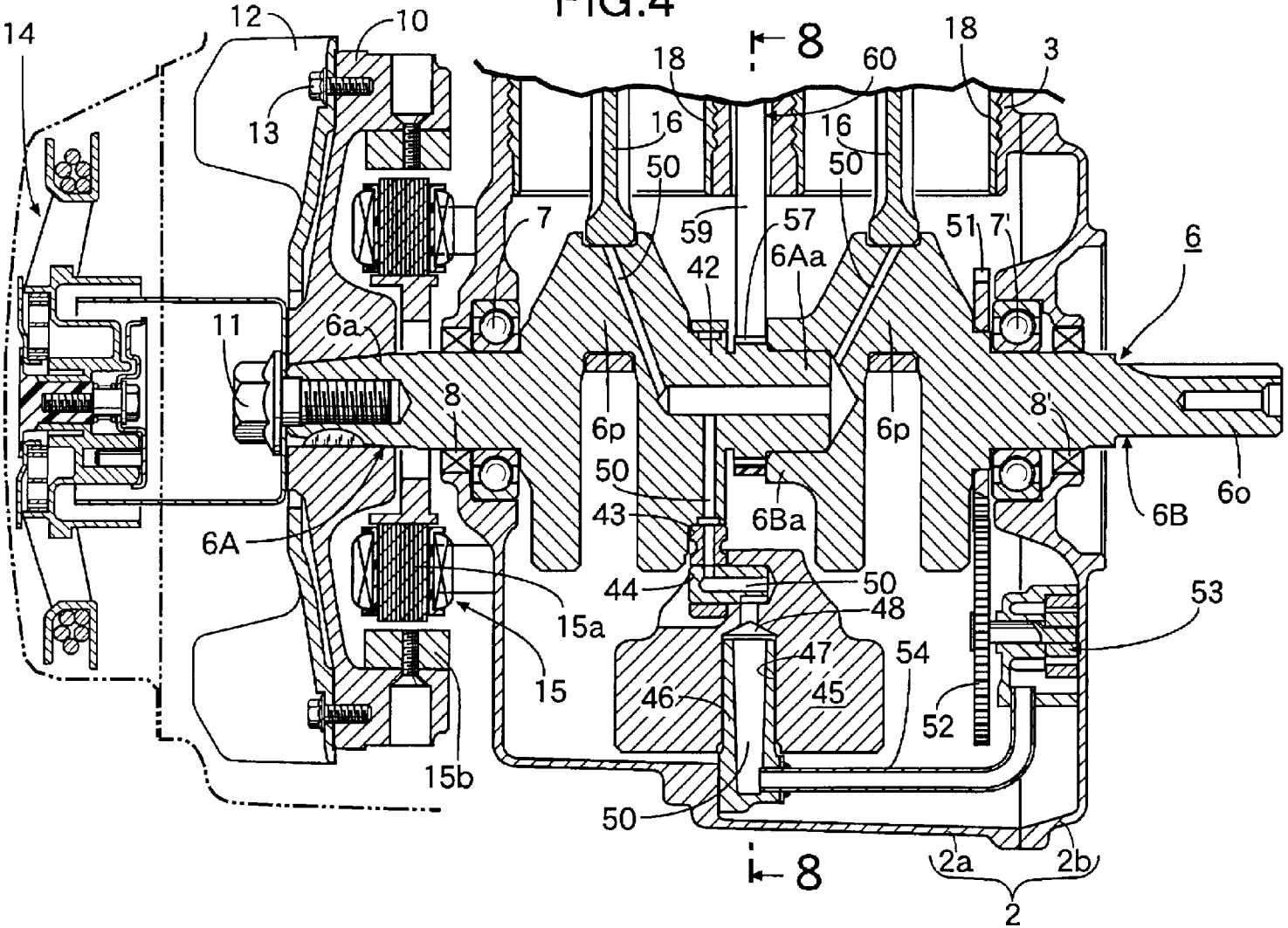
FIG. 4 is a sectional view taken along a line 4-4 in FIG. 1.
Figure 5:
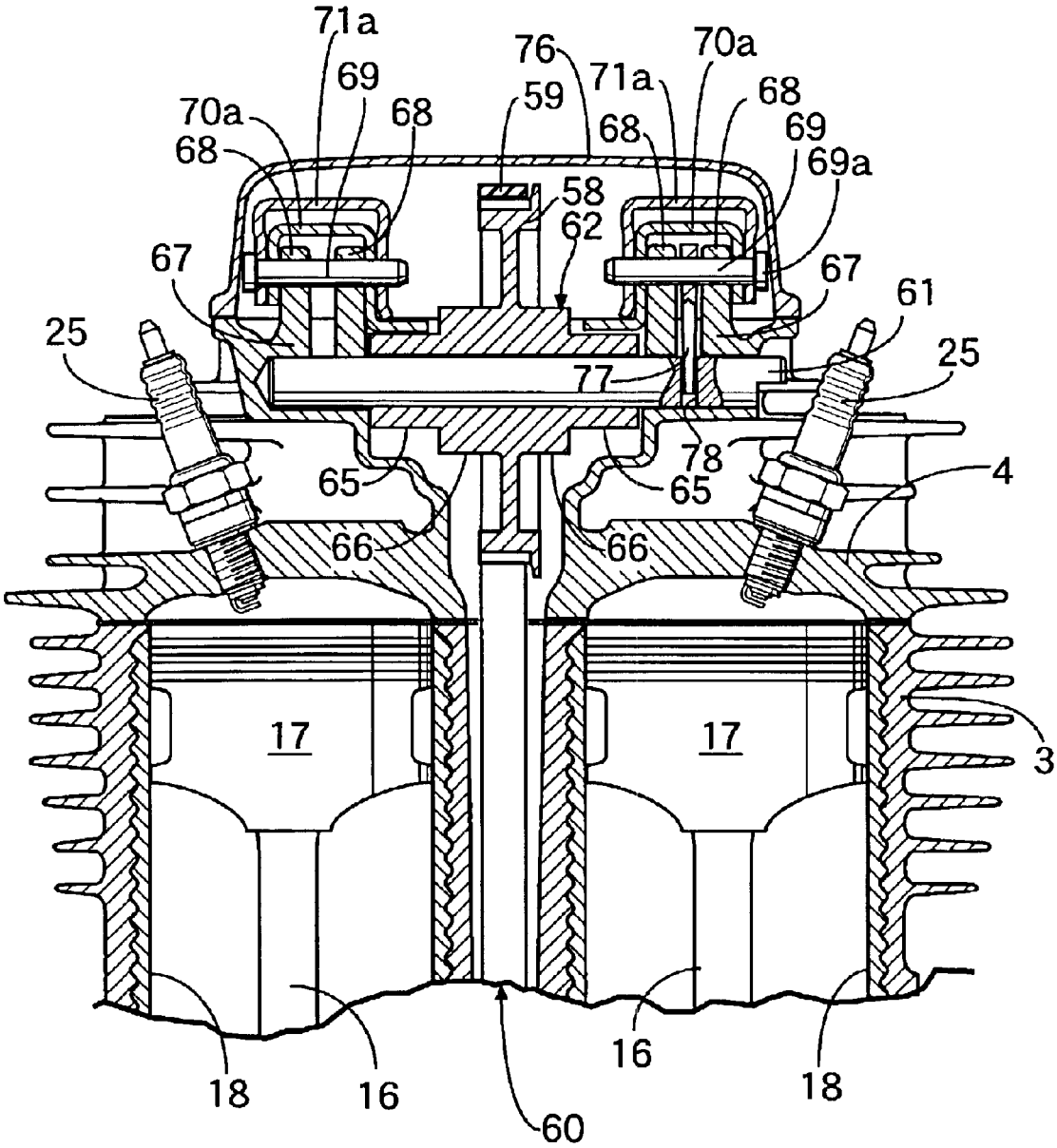
FIG. 5 is a sectional view taken along a line 5-5 in FIG. 1.
Figure 6:
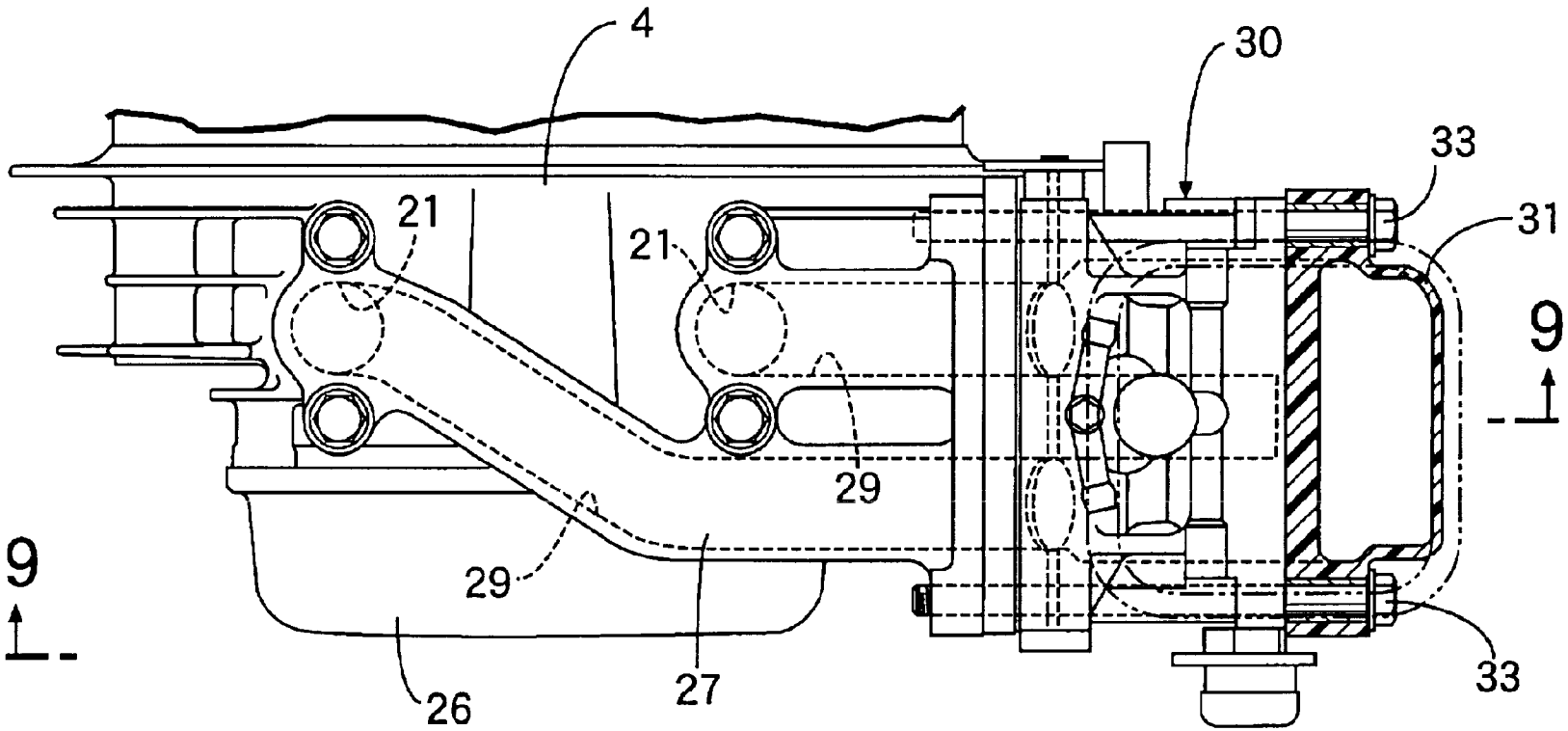
FIG. 6 is a sectional view taken along a line 6-6 in FIG. 2.
Figure 7:
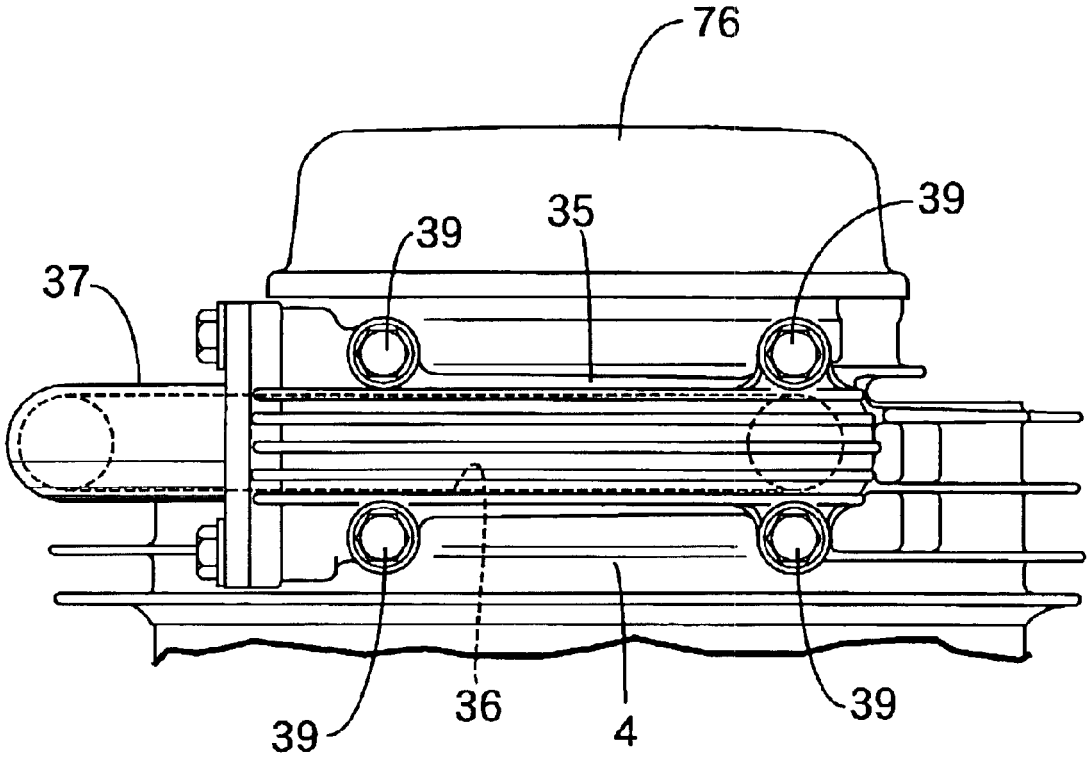
FIG. 7 is a view taken in a direction of an arrow 7 in FIG. 2.

Referring to FIGS. 1, 4 and 5, an engine body 1 of an engine having a balancer comprises a crankcase 2, a cylinder block 3 protruding slightly upward from one side of the crankcase 2, and a cylinder head 4 coupled to a head of the cylinder block 3. The crankcase 2 is adapted to be mounted on engine beds of various operating machines via a mounting case 5 on the lower face of the crankcase 2.

The crankcase 2 comprises a case body 2*a* cast integrally with the cylinder block 3 to have an open end face, and a side cover 2*b* coupled to the opened end. A crankshaft 6 is rotatably carried at its opposite ends on the case body 2*a* and the side cover 2*b* with ball bearings 7 and 7' and oil seals 8 and 8' interposed therebetween. The crankshaft 6 protrudes out of the crankcase 2 with one end serving as an output shaft portion 6*o* and the other end serving as an auxiliary-mounting shaft portion 6*a*. A flywheel 10 is key-coupled to the auxiliary-mounting shaft portion 6*a* and secured thereto by a bolt 11. A cooling fan 12 for supplying cooling air to various portions of the engine body 1 and a carburetor 30, which will be described hereinafter, is secured to an outer end face of the flywheel 10 by bolts 13. A recoiled engine starter 14 is disposed outside the cooling fan 12.

A stator 15*a* of a generator 15 is mounted to an outer end face of the crankcase 2 opposed to the flywheel 10. The flywheel 10 includes a plurality of magnets 15*b* disposed around an outer periphery of the stator 15*a* and also serves as a rotor of the generator 15.

The crankshaft 6 includes a pair of crankpins 6*p*, 6*p* having a phase difference of 360° within the crankcase 2. A pair of pistons 17, 17 are connected to the crankpins 6*p*, 6*p* through connecting rods 16, 16, respectively. A pair of cylinders 18, 18, in which the pistons 17, 17 are slidably received, are defined in the cylinder block 3 in parallel to each other.

Combustion chambers 20, 20, intake ports 21, 21 and exhaust port 22, 22 are defined in the cylinder head 4 in correspondence to the cylinders 18, 18. Intake valves 23, 23 and exhaust valves 24, 24 for opening and closing the intake ports 21, 21 and exhaust port 22, 22 are mounted in the cylinder head 4. In this case, the intake ports 21, 21 and exhaust port 22, 22 are disposed vertically, so that upstream ends of the intake ports 21, 21 open into an upper face of the cylinder head 4, and downstream ends of the exhaust ports 22, 22 open into a lower face of the cylinder head 4.

Spark plugs 25, 25 are threadedly fitted into the cylinder head 4 from laterally opposite sides with their electrodes facing into the combustion chambers 20, 20.

As shown in FIGS. 1, 2, 6 and 7, an intake manifold 27 is secured to the upper face of the cylinder head 4 by bolts 28. The intake manifold 27 includes a pair of intake passages 29, 29 horizontally extending to individually communicate with the intake ports 21, 21. Upstream ends of the intake passages 29, 29 open toward one side of the cylinder head 4, on the same side of the cylinder head 4 as the cooling fan 12, and a twin carburetor 30 is connected to the openings. In this manner, the carburetor 30 is disposed so as to adjoin the cooling fan 12 in its radial direction.

An air cleaner 32 is connected to an upstream end of the carburetor 30 through an intake duct 31 having an upstream end turned upwards. The air cleaner 32 is disposed above the cylinder block 3 and the cylinder head 4.

The carburetor 30 and the intake duct 31 are coupled to the intake manifold 27 by a plurality of through-bolts 33. The air cleaner 32 is mounted to the intake duct 31 by a single mounting bolt 34 embedded in the intake duct 31.

Figure 2:
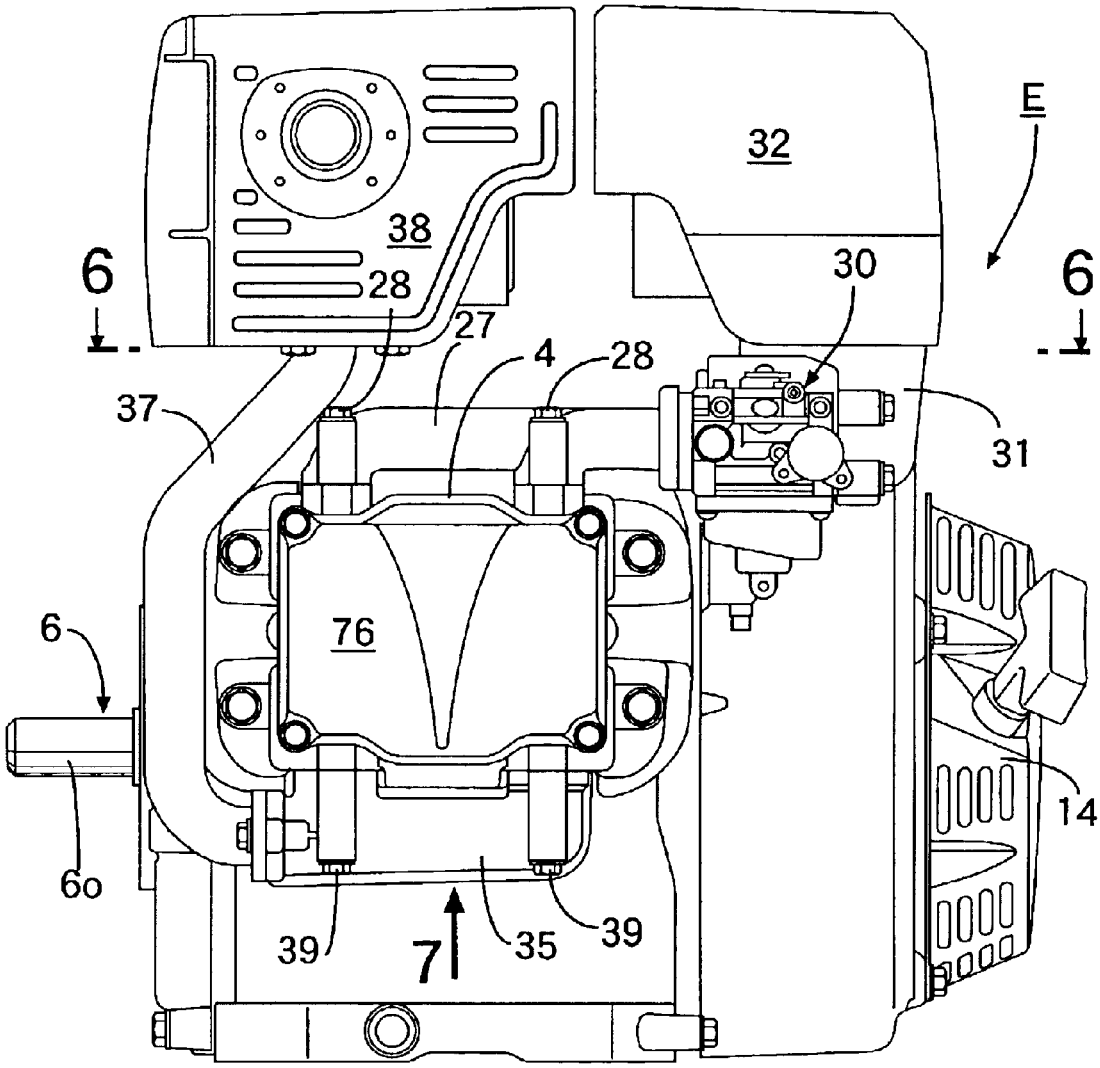
FIG. 2 is a view taken in a direction of an arrow 2 in FIG. 1.

An exhaust manifold 35 is secured to the lower face of the cylinder head 4 by bolts 39. The exhaust manifold 35 includes a single exhaust passage 36 horizontally extending to commonly communicate with the exhaust ports 22, 22. The exhaust passage 36 opens toward the other side of the cylinder head 4. An exhaust pipe 37 is disposed on the other side of the cylinder head 4 opposite from the carburetor 30 and connected to a downstream end of the exhaust pipe 37, and a muffler 38 is connected to an upper end of the exhaust pipe 37. In this manner, the air cleaner 32 and the muffler 38 are disposed adjacent to each other along an axis of the crankshaft 6 above the cylinder block 3 and the cylinder head 4, as shown in FIGS. 2 and 3.

Figure 3:
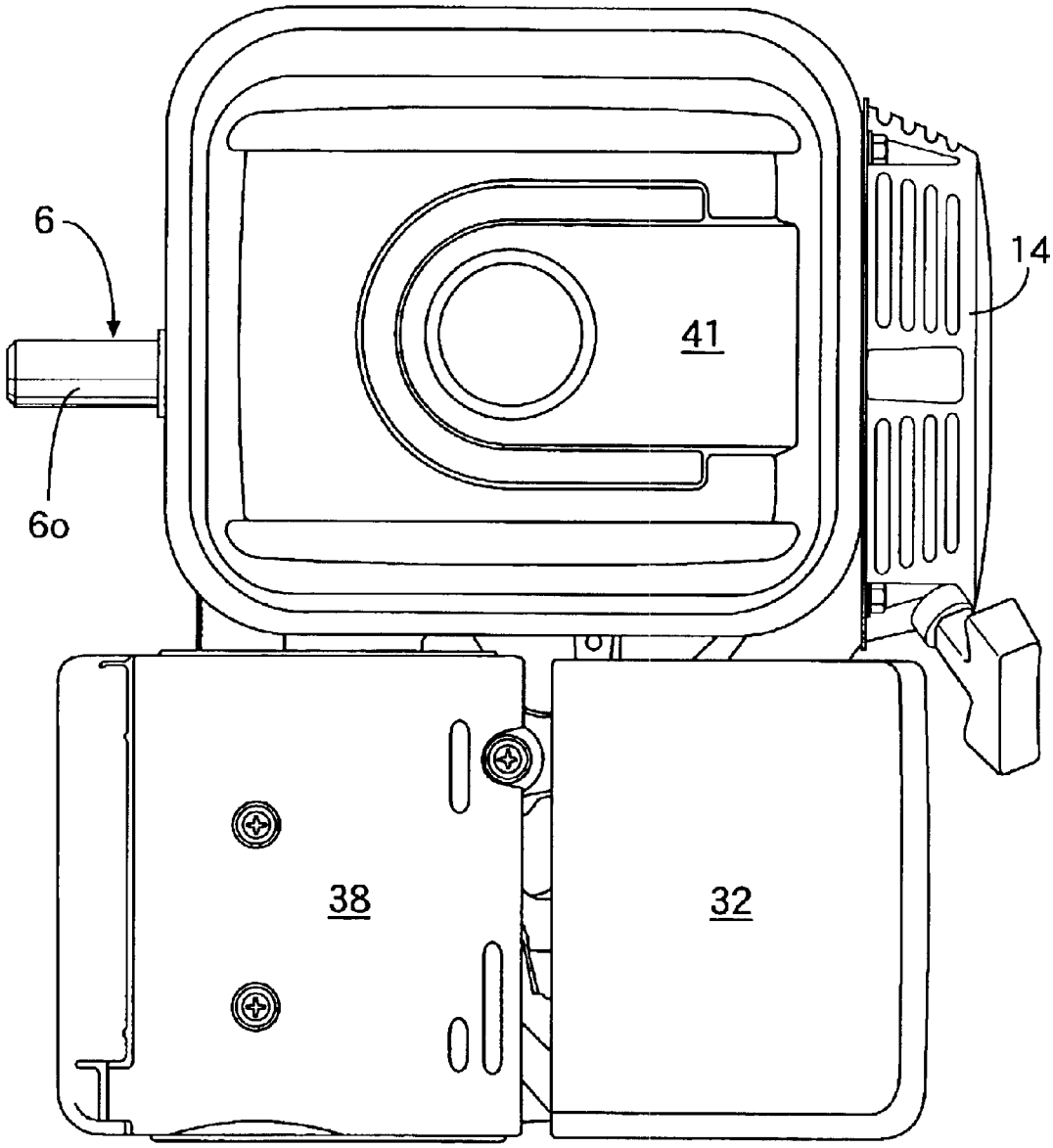
FIG. 3 is a view taken in a direction of an arrow 3 in FIG. 1.

A fuel tank 41 is disposed adjacent the air cleaner 32 and the muffler 38 above the crankcase 2, and supported on a bracket 40 protruding from the upper face of the crankcase 2 (see FIGS. 1 and 3).

Figure 8:
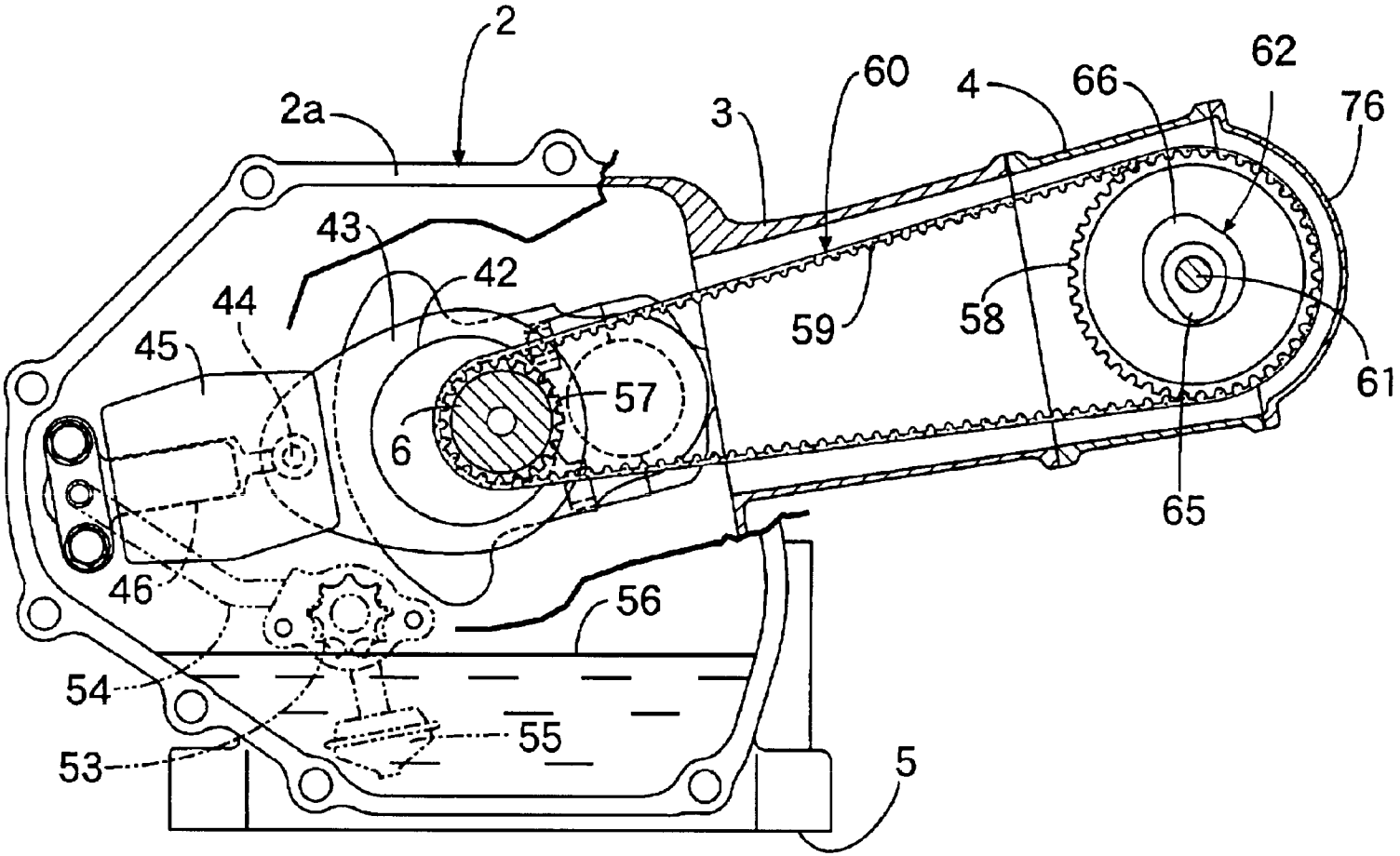
FIG. 8 is a sectional view taken along a line 8-8 in FIG. 4.
Figure 9:
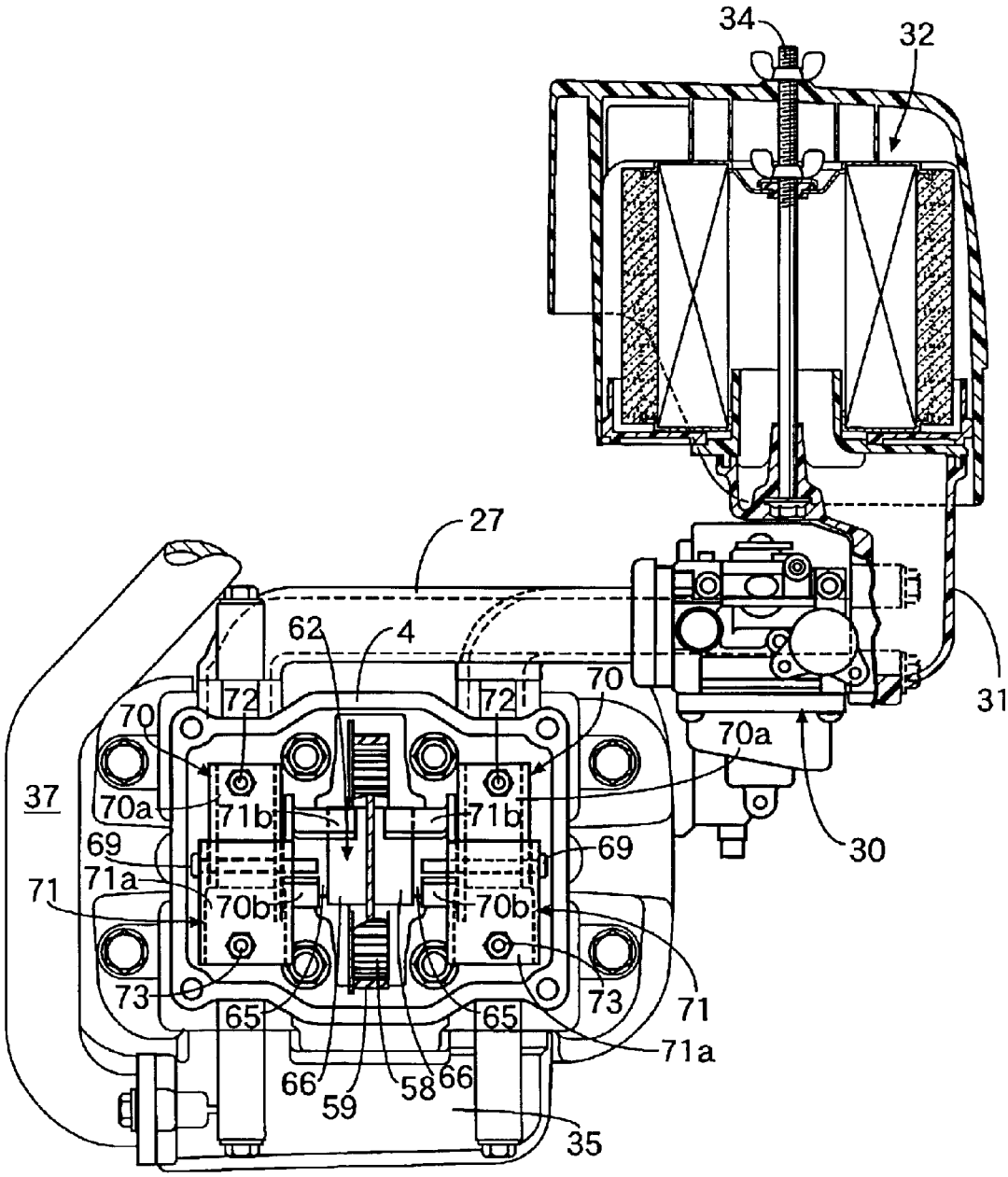
FIG. 9 is a sectional view taken along a line 9-9 in FIG. 6.
Figure 10C:
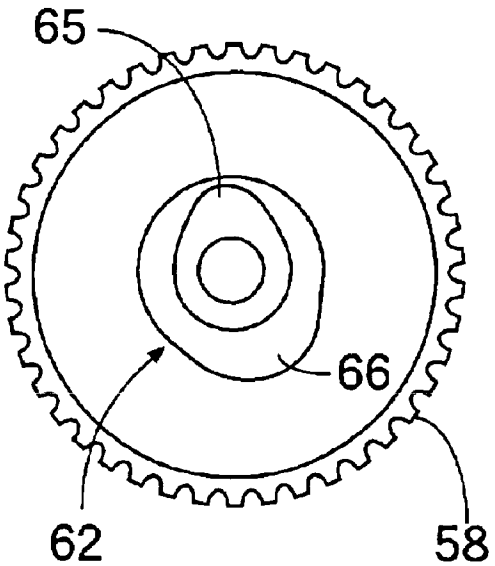
FIG. 10C is a right side view of the camshaft.
Figure 10A:
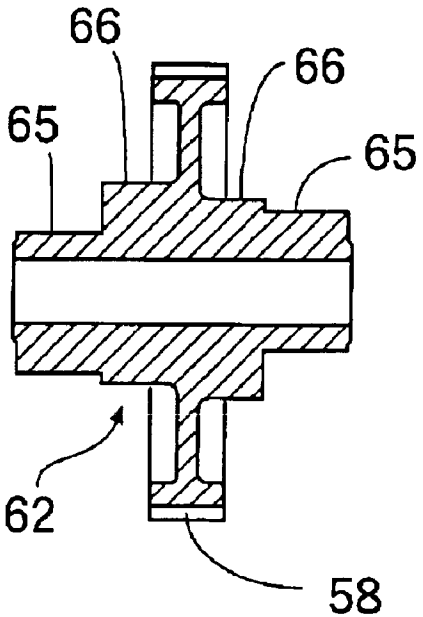
FIG. 10A is a vertical sectional view of a camshaft.
Figure 10B:
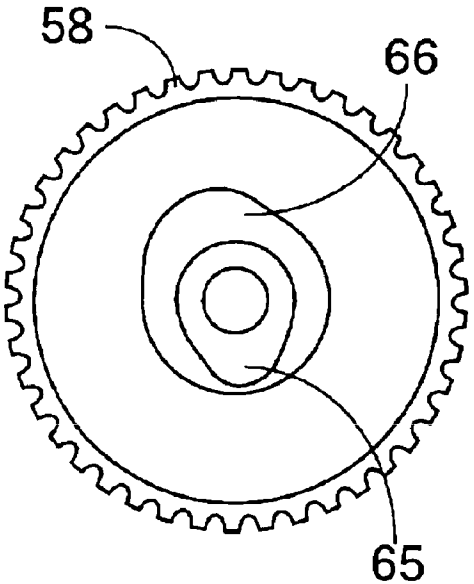
FIG. 10B is a left side view of the camshaft.

Referring to FIGS. 4 and 8, an eccentric shaft portion 42 is formed at a central portion of the crankshaft 6. A link 43 is rotatably fitted at its larger end over the eccentric shaft portion 42. A balance weight 45 is connected to a smaller end of the link 43 through a pivot 44 parallel to the crankshaft 6. The balance weight 45 has a guide bore 47 which slidably fits over an outer periphery of a guide shaft 46 secured to an inner wall of the crankcase 2 and extending in parallel to axes of the cylinders 18, 18. The balance weight 45 reciprocates in a direction opposite to that of the pistons 17, 17 sliding within the cylinders 18, 18 during operation of the engine E, and exhibits an inertia force substantially equivalent to that of the pistons 17, 17.

The crankshaft 6 is formed from a crankshaft half 6A including the auxiliary-mounting shaft portion 6*a*, a drive timing pulley 57 (which will be described hereinafter) and the eccentric shaft portion 42; and a crankshaft half 6B including the output shaft portion 6*o*. After assembling of the link 43 to the eccentric shaft portion 42, opposed ends 6Aa and 6Ba of the crankshaft halves 6A and 6B are press-fitted and coupled to each other.

By providing a phase difference of 360° to the pair of crankpins 6*p*, 6*p* of the crankshaft 6, the engine E is constructed to be a parallel 2-cylinder engine with equal combustion intervals. Therefore, even if the displacement is increased, a reduction in vibration can be provided by dispersing the explosion vibration, and a further reduction in vibration of the engine E can be provided by balancing the inertia forces of the balance weight 45 and the pistons 17, 17. Moreover, since the intake and exhaust manifolds 27 and 35 are disposed horizontally above and below the cylinder head, and the carburetor 30 and the exhaust pipe are disposed on opposite sides of the cylinder head 4, a large space can be secured for the air cleaner 32 and the muffler 38 above the cylinder block 3 and the cylinder head 4, while compactly arranging components around the cylinder head 4. This contributes to a compactness of the engine E. Furthermore, the heating of the intake system by the exhaust system can be avoided without use of a special heat-shielding plate, which can contribute to simplification of the structure.

The carburetor 30 is disposed to radially adjoin the cooling fan 12 connected to one end of the crankshaft 6, and the space around the cooling fan 12 can be effectively utilized for installation of the carburetor 30, to further contribute to the compactness of the engine E.

Further, the air cleaner 32 and the muffler 38 are disposed adjacent to each other along the axial direction of the crankshaft 6 above the cylinder block 3 and the cylinder head 4, and the fuel tank 41 adjoining the air cleaner 32 and the muffler 38 is disposed above the crankcase 2. Therefore, the space above the cylinder block 3, the cylinder head 4 and the crankcase 2 can be effectively utilized for installation of the air cleaner 32, the muffler 38 and the fuel tank 41, to further contribute to the compactness of the engine E.

A lubricating system of the engine E will be described below.

Referring to FIGS. 4 and 8, a continuous lubricating oil passage 50 for supplying an oil to the outer peripheral surface of the pair of crankpins 6*p*, 6*p* is defined in the guide shaft 46, the balance weight 45, the pivot 44, the link 43 and the crankshaft 6. A pump oil chamber 48 is provided in the middle of the lubricating oil passage 50. The pump oil chamber 48 is defined in the guide bore 47 of the balance weight 45 by a tip end of the guide shaft 46, so that the volume of the pump oil chamber 48 is expanded and contracted in response to the reciprocation of the balance weight 45.

On the other hand, an oil pump 53 is mounted to an inner wall of the side cover 2*b* and driven by the crankshaft 6 through the driving and driven gears 51 and 52. A discharge port of the oil pump 53 and an inlet of the lubricating oil passage 50 defined in the guide shaft 46 are connected to each other through an oil pipe 54.

Thus, during operation of the engine E, the oil pump 53 draws up a lubricating oil 56 accumulated in the bottom of the crankcase 2 through a strainer 55, and supplies it to the crankpins 6*p*, 6*p* through the oil pipe 54 and the lubricating oil passage 50, to thereby lubricate rotating/sliding surfaces of the crankpins 6*p*, 6*p* on the connecting rods 16, 16.

In this arrangement, the pump oil chamber 48 in the guide bore 47 exhibits a pumping action by repeated expansion and contraction of its volume due to the reciprocation of the balance weight 45. During the contraction of volume, because the discharge pressure of the oil pump 53 functions as a resistance to inhibit the back flow of the oil, the pressure of the oil fed from the oil pump 53 can be effectively increased and supplied toward the crankpins 6*p*, 6*p*, thereby effectively achieving the lubrication. Therefore, it is possible to use the oil pump 53 having a small capacity, and a special one-way valve for preventing the back flow of the oil is not required, leading to reductions in weight and cost.

In the middle of the lubricating oil passage 50, the rotating/sliding surfaces of the eccentric shaft portion 42 and the pivot 44 as well as the sliding surfaces of the guide shaft 46 and the balance weight 45 can be lubricated by the oil passing through the lubricating oil passage 50.

A valve-operating system for the engine E will be described below.

Referring to FIGS. 4, 5, 9 and 10, a drive timing pulley 57 adjoining the eccentric shaft portion 42 is formed at the central portion of the crankshaft 6. A cam support shaft 61 is mounted to the cylinder head 4 so as to be parallel to the crankshaft 6. A timing belt 59 is reeved between the drive timing pulley 57 and a driven timing pulley 58 at a central portion of a cam shaft 62 rotatably carried on the cam support shaft 61. The drive and driven timing pulleys 57 and 58 and the belt 59 forms a timing transmitting device 60 for driving the cam shaft 62 from the crankshaft 6 at a reduction ratio of 1/2.

The camshaft 62 is formed with a pair of exhaust cams 66, 66 arranged with the driven timing pulley 58 interposed therebetween, and intake cams 65, 65 adjoining outer ends of the exhaust cams 66, 66. Each of the outer intake cams 65, 65 is formed at a diameter smaller than that of each of the inner exhaust cams 66, 66, so that the entire intake cam 65 falls within the base circle of the inner exhaust cam 66. The camshaft 62 is disposed on one side of a plane P including axes of the intake valve 23 and the exhaust valve 24, so that its axis is substantially perpendicular to the plane P, and the axial movement of the camshaft 62 is inhibited by a pair of support walls 67, 67 formed on the cylinder head 4 to support opposite ends of the cam support shaft 61. A pair of small support walls 68, 68 are integrally connected to the support walls 67, 67, and a rocker shaft 69 disposed in parallel to the cam support shaft 61 and substantially perpendicularly to the plane P is supported at its opposite ends on the small support walls 68, 68. An intake rocker arm 70 and an exhaust rocker arm 71 are individually swingably carried on the rocker shaft 69. Namely, the intake rocker arm 70 and the exhaust rocker arm 71 are supported by the single common rocker shaft 69.

The intake rocker arm 70 comprises a first arm portion 71*a* having a U-shaped section with opposed sidewalls of its base end being carried on the rocker shaft 69 and with its tip end abutting against a head of the intake valve 23 through an adjusting bolt 72, and a second arm portion 70*b* extending from one of the sidewalls of the first arm portion 70*a* to come into sliding contact with the outer peripheral surface of the intake cam 65.

The exhaust rocker arm 71 comprises a first arm portion 71*a* having a U-shaped section with opposed sidewalls of its base end being carried on the rocker shaft 69 and covering the base end of the first arm portion 70*a* and with its tip end abutting against a head of the exhaust valve 24 through an adjusting bolt 73, and a second arm portion 71*b* extending from one of the sidewalls of the first arm portion 71*a* to come into sliding contact with the outer peripheral surface of the exhaust cam 66.

Valve springs 74 and 75 are mounted to the intake and exhaust valves 23 and 24 for biasing the intake and exhaust valves 23 and 24 in closing directions, respectively.

Each of the rocker shafts 69 has an enlarged head portion 69*a* at an outer end turned outwards and sideways of the cylinder head 4. The head portion 69*a* is disposed to abut against an inner surface of a head cover 76 which is coupled to the cylinder head 4 to cover the valve-operating system. Therefore, in a state in which the head cover 76 is removed, it is possible to insert and withdrawn the rocker shafts 69, 69 into and out of the small support walls 68, 68. However, in a state in which the head cover 76 is mounted, the removal of the rocker shafts 69, 69 out of the small support walls 68, 68 is inhibited by an inner wall of the head cover 76.

A slip-out preventing pin 77 is mounted on the rocker shaft 69 between the small support walls 68, 68 and inserted into a transverse bore 78 in the cam support shaft 61, to prevent the removal of the cam support shaft 61 from the support wall 67.

When the camshaft 62 is rotated by the crankshaft 6 through the timing transmitting device 60, the intake and exhaust cams 65 and 66 drive the intake and exhaust rocker arms 70, 71 individually to open and close the intake and exhaust valves 23 and 24 with their inherent opening and closing timings by cooperation with the valve springs 73 and 74, respectively.

Moreover, by merely causing the second arm portions 70*b* and 71*b* in sliding contact with the intake and exhaust cams 65 and 66 to protrude axially from the corresponding first arm portions 70*a* and 71*b*, while utilizing a step formed between the small-diameter intake cam 65 and the large-diameter exhaust cam 66 in the intake and exhaust rocker arms 70 and 71, the interferences between the intake cam 65 and the exhaust rocker arm 71 and between the exhaust cam 66 and the intake rocker arm 70 can be avoided. Therefore, the complication of the structure of each of the rocker arms 70 and 71 cannot be brought about.

Since the intake and exhaust rocker arms 70 and 71 are supported by the single common rocker shaft 69, the number of parts can be reduced, leading to an improvement in assemblability and a reduction in cost.

Further, because the rocker shaft 69 supports the opposite sidewalls of the base end of each of the first arm portions 70*a* and 71*a* having the U-shaped section in the intake and exhaust rocker arms 70 and 71, the support rigidity of the base ends can be increased to guarantee the stable swing of the rocker arms 70 and 71. Moreover, by superposing the base ends on each other with one on the inner side and the other on the outer side, the rocker arms 70 and 71 can be compactly disposed, resulting in the compact valve-operating device.

Figure 11:
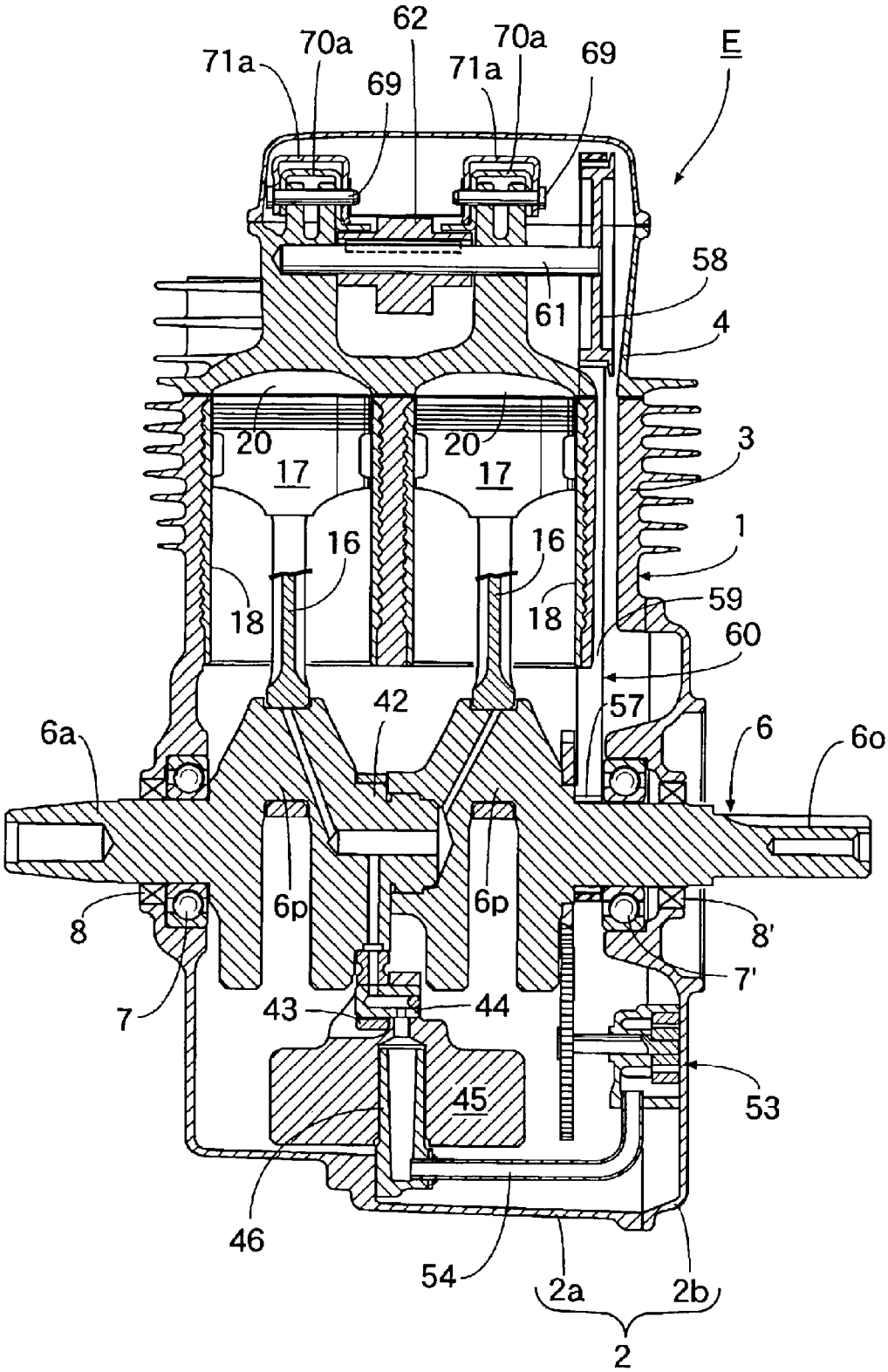
FIG. 11 is a vertical sectional plan view showing an engine including a modification of the device according to the present invention.

FIG. 11 shows an engine including a modification of the device according to the present invention and having the same arrangement as that of the above-described embodiment, except that a timing transmitting device 60 is disposed adjacent the inner wall of the side cover 2*b*, a driven timing pulley 58 of the timing transmitting device 60 is secured to a cam support shaft 61, a camshaft 62 is key-coupled to the cam support shaft 61, and the driven timing pulley 58 drives the camshaft 62 through the cam support shaft 61. In FIG. 11, portions or components corresponding to those in the above-described embodiment are denoted by the same reference numerals and symbols, and the description thereof is omitted.

Although the embodiment of the present invention has been described in detail, it will be understood that the present invention is not limited to the above-described embodiments, and various modifications in design may be made without departing from the spirit and scope of the invention defined in the claims. For example, the intake cam 65 and the exhaust cam 66 may be formed on a large-diameter side and a small-diameter side respectively in the camshaft 62, and the exhaust rocker arm 71 may be disposed inside the intake rocker arm 70. The valve-operating device according to the present invention is also applicable to a single-cylinder engine.

What is claimed is:

1. A valve-operating device for an engine, comprising: a camshaft which is disposed on one side of a plane axes of a first valve and a second valve corresponding to one and the other of an intake valve and an exhaust valve and which has an axis substantially perpendicular to the plane; and a first rocker arm and a second rocker arm which are swingably carried on a common rocker shaft disposed substantially perpendicular to the plane and through which the camshaft and the first and second valves are connected to each other, whereby the first and second valves are opened and closed by the rotation of the camshaft, wherein the first rocker arm comprises a first arm portion with opposed sidewalls of its base end having a u-shaped section being carried on the rocker shaft and with its tip end abutting against a head of the first valve, and a second arm portion protruding from one of the sidewalls of the first arm portion with its tip end being in sliding contact with the camshaft; and wherein the second rocker arm comprises a first arm portion with opposed sidewalls of its base end having a U-shaped section being carried on the rocker shaft inside the first arm portion of the first rocker arm and with its tip end abutting against a head of the second valve, and a second arm portion protruding from one of the sidewalls of the first arm portion with its tip end being in sliding contact with the camshaft.

2. A valve-operating device for an engine, comprising:

a camshaft which is disposed on one side of a plan; including axes of a first valve and a second valve corresponding to one and the other of an intake valve and an exhaust valve, and which has an axis substantially perpendicular to the plane; and a first rocker arm and a second rocker arm which are swingably carried on a single common rocker shaft, disposed substantially perpendicular to the plane, and through which the camshaft and the first and second valves are connected to each other, whereby the first and second valves are opened and closed by the rotation of the camshaft, wherein the camshaft is provided with a large-diameter first cam and a small-diameter second cam adjoining a portion of the first cam on the one side of the plane;

wherein the first and second rocker arms are provided with arm portions extending in an axial direction of the camshaft to come into sliding contact with outer peripheral surfaces of the first and second cams, respectively;

wherein the first rocker arm comprises a first arm portion with opposed sidewalls of its base end having a U-shaped section being carried on the rocker shaft and with its tip end abutting against a head of the first valve, and a second arm portion protruding from one of the sidewalls of the first arm portion with its tip end being in sliding contact with an outer peripheral surface of the first cam; and further wherein the second rocker arm comprises a first arm portion with opposed sidewalls of its base end having a U-shaped section being carried on the rocker shaft in nested relation inside the first arm portion of the first rocker arm and with its tip end abutting against a head of the second valve, and a second arm portion protruding from one of the sidewalls of the first arm portion of said second rocker arm with its tip end being in sliding contact with an outer peripheral surface of the second cam.

* * * * *